US008696535B2

(12) United States Patent
Vizanova Alzamora

(10) Patent No.: US 8,696,535 B2
(45) Date of Patent: Apr. 15, 2014

(54) MULTIFORMAT BOX FORMING MACHINE

(75) Inventor: Manuel Vizanova Alzamora, Girona (ES)

(73) Assignee: Tavil-Indebe S.A.U., Sant Joan les Ponts (ES)

( * ) Notice: Subject to any disclaimer, the term of this patent is extended or adjusted under 35 U.S.C. 154(b) by 229 days.

(21) Appl. No.: 13/288,535

(22) Filed: Nov. 3, 2011

(65) Prior Publication Data

US 2012/0115698 A1 May 10, 2012

(30) Foreign Application Priority Data

Nov. 5, 2010 (EP) ..... 10382290

(51) Int. Cl.
*B31B 3/00* (2006.01)

(52) U.S. Cl.
CPC ..... *B31B 3/00* (2013.01)
USPC ..... 493/126; 493/51; 493/143

(58) Field of Classification Search
CPC ..... B31B 2203/003; B31B 49/02; B31B 2201/22; B31B 2201/223; B31B 2201/252; B31B 2219/141; B31B 1/76; B31B 3/00
USPC ..... 493/122, 124, 126, 128, 143, 176
See application file for complete search history.

(56) References Cited

U.S. PATENT DOCUMENTS

| | | | | |
|---|---|---|---|---|
| 3,631,769 | A | 1/1972 | Hammerle | |
| 4,033,242 | A | 7/1977 | Rice et al. | |
| 4,581,005 | A * | 4/1986 | Moen | 493/167 |
| 4,596,542 | A * | 6/1986 | Moen | 493/89 |
| 4,596,543 | A * | 6/1986 | Reiser et al. | 493/91 |
| 5,024,641 | A | 6/1991 | Boisseau | |
| 5,382,155 | A | 1/1995 | Boix Jaen | |
| 5,807,223 | A * | 9/1998 | Holton | 493/84 |
| 5,971,906 | A * | 10/1999 | Tharpe et al. | 493/131 |
| 6,319,183 | B1 * | 11/2001 | Ballos, III | 493/37 |
| 7,470,226 | B1 * | 12/2008 | Herrin | 493/143 |
| 2006/0205579 | A1 * | 9/2006 | Boix Jaen | 493/143 |
| 2008/0127613 | A1 | 6/2008 | Ware et al. | |
| 2008/0223002 | A1 * | 9/2008 | Lanfranchi | 53/250 |

FOREIGN PATENT DOCUMENTS

| | | |
|---|---|---|
| CA | 2110766 | 6/1995 |
| DE | 4233923 | 4/1994 |
| ES | 8606124 | 4/1985 |

OTHER PUBLICATIONS

EPO Machine Translation for DE 4233923 [Retrieved Aug. 7, 2013].*

* cited by examiner

*Primary Examiner* — Sameh Tawfik
(74) *Attorney, Agent, or Firm* — Gardner, Groff, Greenwald & Villanueva, P.C.

(57) ABSTRACT

Multiformat box forming machine which comprises, at least, a storage unit (1) for die-cut cardboard sheets (2), a loader (3) for unit-by-unit dispensing of the die-cut sheets (2), means (4) for guiding and positioning the die-cut sheet (2), means (5) for supplying an adhesive substance on the die-cut cardboard sheet (2), a shaping unit (6) which comprises at least a vertically displaceable inner mould and an exterior matrix, and means (9) for discharging the formed box (10). The mould and the matrix of the shaping unit (6) are divided into four segments, respectively, which allow horizontal displacement and positioning thereof at the points which coincide with the lower corners of the box (10), it having been provided that each one of the units of mould-matrix segments move solidly joined together.

10 Claims, 7 Drawing Sheets

MULTIFORMAT BOX FORMING MACHINE

CROSS REFERENCE TO RELATED APPLICATION

This application claims priority upon European Application No. EP10382290.4, filed Nov. 5, 2010. This application is hereby incorporated by reference in its entirety for all of its teachings.

DESCRIPTION

Object of the Invention

The main object of the present invention consists of a multiformat box forming machine, from die-cut cardboard sheets, which have three differentiated areas: a loading area, a shaping area and a discharge area.

The machine object of the present invention allows the shaping of different cardboard box formats with the same machine, saving down times and costs associated thereto, thanks to an automatic format changing system.

BACKGROUND OF THE INVENTION

Cardboard boxes represent a widely used means for storing, transporting and distributing all kinds of products. In fact, the manufacturing and distributing companies use cardboard boxes to package their products in packaging units for their subsequent storage, transport and distribution.

Currently, the packaging or packing process is integrated in the manufacturing process of the product, so manufacturing industries have their own means for producing boxes, according to their needs regarding formats and quantities. In order to cover all of the packaging needs, the industries have a broad variety of cardboard box formats, stored in the form of die-cut cardboard sheets in order to optimise their storage space. Depending on the characteristics, size and number of products to be packaged, the suitable box format is selected, and the corresponding die-cut sheets are placed in the forming machine for the shaping thereof in the production and/or packaging line.

These box forming machines generally have a loader which dispenses the die-cut sheets unit-by-unit into the shaping area, where a series of automatisms fold the peripheral flaps of the sheet to produce the lateral walls of the box and gluing thereof.

Several box forming machine machines appear in the state of the art, such as those we will set forth below:

Patent CA2110766A1 discloses an open lid cardboard box shaping machine from flat pieces of cardboard and by means of actuating gluing means for the flaps.

Patent ES198606124A1 discloses a machine for shaping cardboard boxes or trays, and folding down and inlaying the panels which form double walls with the bottom inside the box, once the box is shaped, concluding therewith the automatic formation of the tray. It also reflects the possibility of providing the ability to shape different open boxes or trays from pre-formed cardboard plates.

Patent US20080127613 discloses a box shaping machine with upper aperture through the raising of the lateral flaps of a flat extended piece, wherein said flaps are joined articulated to a base; all of this defined in a single flat piece. The machine disclosed has sheet loading means, box shaping means from the sheets coming from the loading means and box distribution means once they have been shaped.

Market requirements mean that it is becoming more necessary to carry out short and varied productions, so packaging of boxes implies constant format changes of the boxes to be used. Box format changes mean the requirement of modification of parameters, folding and shaping tools of the machine, with the consequent time loss entailed therewith. In effect, previously disclosed machines require a preparation and adjustment time to adapt them to the new box format, which translates into long down times, which reduce their profitability, particularly in the packaging of small orders or short productions.

DESCRIPTION OF THE INVENTION

The multiformat box forming machine proposed by the invention resolves the previously mentioned drawbacks by allowing the format of the box to be formed to be changed quickly and automatically, in order to optimise the production and packaging lines.

Therefore, and more specifically, the multiformat box forming machine comprises, at least, a storage unit for die-cut cardboard sheets, a loader for unit-by-unit dispensing of the die-cut sheets, means for guiding and positioning the die-cut sheet, means for supplying an adhesive substance on the die-cut cardboard sheet, a shaping unit which comprises at least a vertically displaceable inner mould and an exterior matrix, and means for discharging the formed box. For the machine to be able to adapt to the different box formats, the mould and the matrix of the shaping unit are divided into four segments which allow horizontal displacement and positioning thereof at the points which coincide with the lower corners of the box, it having been provided that each one of the units of mould-matrix segments move solidly joined together so as to maintain the clearances between mould and matrix.

In order to facilitate the positioning and centring of the die-cut cardboard sheets in the shaping unit, both the storage unit and the means for guiding and positioning the sheets comprises a mechanism for adjusting the width of the storage unit base, as well as the distance of the lateral rails of the means for guiding and positioning the sheets.

Once the inner mould has inlaid the cardboard sheet inside the matrix, lateral blades, articulated at each one of the matrix segments for folding the inner box flaps, are actuated. The actuation of said lateral blades can be pneumatic, hydraulic, or electric, preferably pneumatic. These actuation means drive the lateral blades in a rotational movement which will fold the inner flaps inwards.

Once the four inner flaps have been folded, the lateral flaps are also folded by the action of curved plates disposed on the sides of each one of the matrix segments. These curved plates are mounted on folding platforms, articulated at the sides of each one of the matrix segments, the folding platforms whereof further comprising a press actuated by a pneumatic cylinder, which strengthens the joining of the inner flaps against the lateral flaps by means of the adhesive substance previously placed on the areas of common contact. Said platforms are folded down through actuation means so that, once the box is formed, the platforms can be retracted, with their respective curved plates and presses, and clear the path for the box to be discharged. The actuation means of said folding platforms can be pneumatic, hydraulic or electric, preferably pneumatic.

Both the lateral folding blade and the lateral folding platform bearing the curved plate and the press, as well as the actuation means thereof, are mounted on each one of the matrix segments, so that they move solidly joined therewith during the format changes, to position themselves on each one of the lower corners of the box.

The shaping unit comprises a format changing mechanism which comprises four C-shaped arms, bearing the matrix segments at the lower ends thereof, whose arms are assembled, from the upper ends thereof, on a first set of rails, assisted by a pair of motorized screws, for its longitudinal displacement, whose first set of rails is mounted on a second set of rails, also assisted by another pair of motorized screws, for its longitudinal displacement. We can position the four mould-matrix segment units at the points which coincide with the lower corners of the box by actuating the motorized screws.

The motorized screws comprise a threaded shaft with two equal spiral portions in each direction, i.e. one threaded to the left and another threaded to the right, so that when the motor makes the screw turn, the respective mould-matrix segment units move in the opposite direction, respectively getting further apart or closer together.

In order to facilitate the shaping of the box inside the shaping unit, each one of the mould segments comprises a suction pad at the lower end thereof for fastening the box.

The shaping of the box is performed by means of the vertical displacement of the mould inside the matrix. To do this, the shaping unit comprises actuation means for the vertical and alternate displacement of the four segments which shape the mould.

In a preferred embodiment, the actuation means of the four segments which shape the inner mould comprise an electric motor and a rotating slider crank mechanism which transforms the rotational movement into an alternative linear movement.

On the other hand, it must be pointed out that the four segments which shape the inner mould are connected to the actuation means for vertical and alternative displacement, through four articulated arms with vertical axes of rotation, connected at the outer end to the upper ends of the mould rod, and at the lower end on two slides which slide along a transversal rail connected to the actuation means, in order to allow the horizontal displacement of the four inner mould segments and the positioning thereof on the lower corners of the box.

Likewise, in must be stated that the multiformat box forming machine comprises means for supplying the adhesive substance, which comprise at least two dispensing guns, arranged on the guiding means, before the inlet to the shaping unit, which deposit a strand of adhesive substance on the lateral flaps of the die-cut cardboard sheet.

Finally, it must be indicated that the forming machine comprises a control panel which governs and coordinates the various actuation means for the general operation of the machine, and that it also governs the actuation of the various motorized screws to administer the box format changes.

DESCRIPTION OF THE DRAWINGS

In order to complement the description being made and in order to help towards a better understanding of the characteristics of the invention, in accordance with a preferred practical example of embodiment thereof, a set of drawings is attached as an integral part of said description, wherein the following, in an illustrative and non-limiting character, has been represented.

PREFERRED EMBODIMENT OF THE INVENTION

Figure 1:
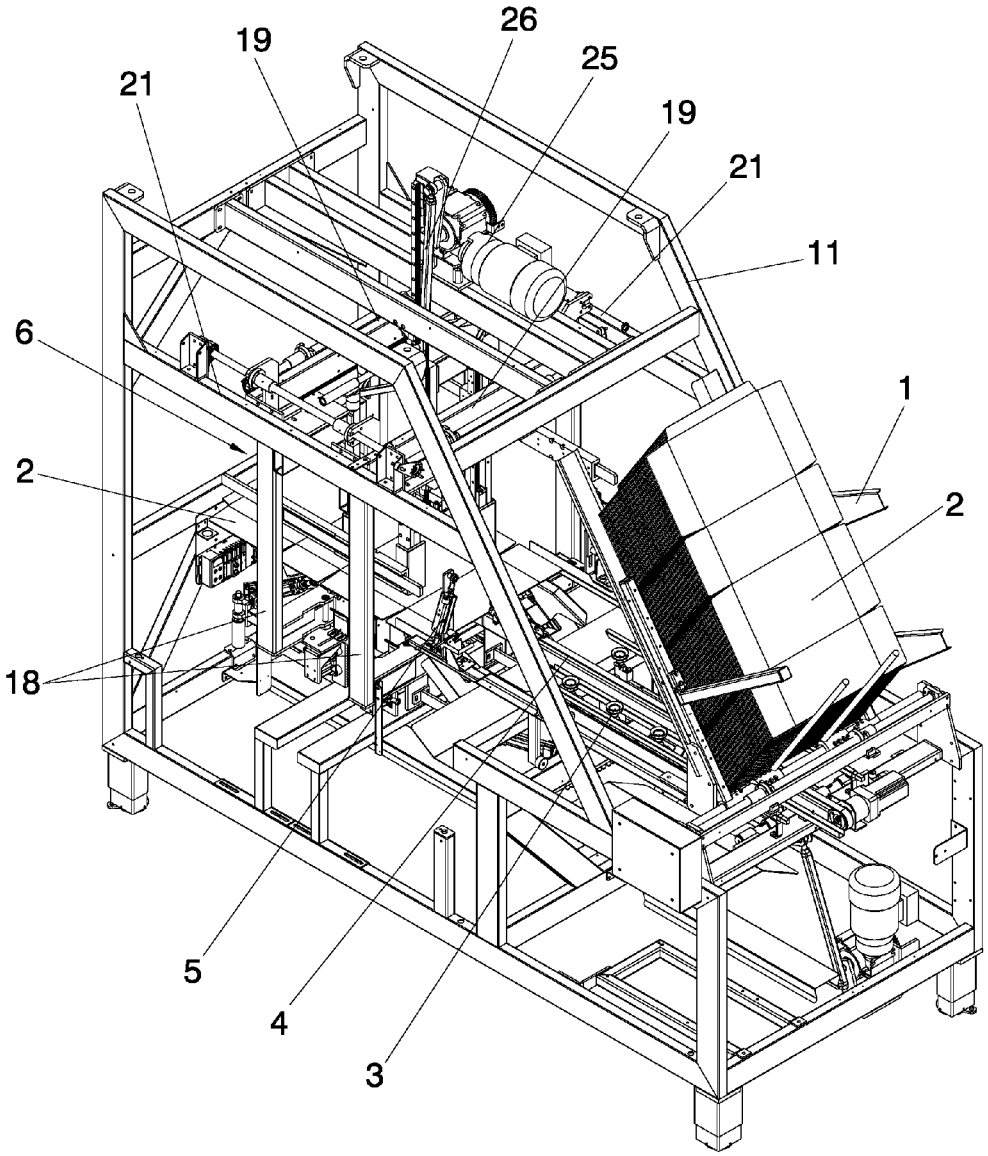
FIG. 1 shows a perspective view of the multiformat box forming machine object of the present invention, with a die-cut cardboard sheet disposed in the shaping unit.

In view of the aforementioned figures it can be observed that the multiformat box forming machine comprises a storage unit (1) for die-cut cardboard sheets (2), a loader (3) for unit-by-unit dispensing the die-cut cardboard sheets (2), means for guiding and positioning the die-cut sheet (2), a pair of glueguns (5) for supplying an adhesive substance on the die-cut cardboard sheet (2), a shaping unit (6) which comprises an inner mould divided into four segments (7*a*, 7*b*, 7*c*, 7*d*) and an exterior matrix also divided into four segments (8*a*, 8*b*, 8*c*, 8*d*), an articulated arm (9) provided with a suction pad for discharging the formed box (10), all of that built into a general chassis (11).

The box (10) forming process is initiated with the placement of the corresponding die-cut cardboard sheets (2) in the storage unit (1), wherefrom the loader (3) consisting of an articulated arm provided with suction pads removes a cardboard sheet (2) and deposits it on a rail (4) provided with a fastening pin, which positions it inside the shaping unit (6).

On the path from the storage unit (1) to the shaping unit (6), the machine has two glueguns (5) which supply a strand of an adhesive substance which, once the box has been shaped, will fix its walls by overlapping with the corresponding flaps, which we will explain further on.

Figure 2:
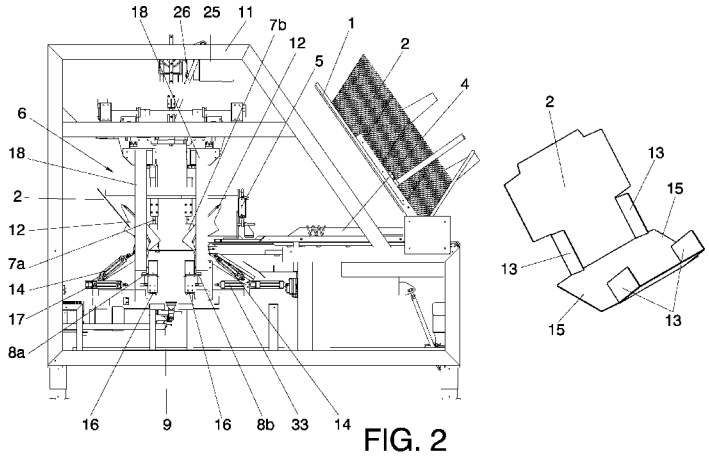
FIG. 2 shows an elevational view of the machine in operation with the inner mould inlaying the die-cut cardboard sheet on the matrix. This figure is accompanied by a representation of the die-cut cardboard sheet, illustrating the configuration that is being adopted by the box in this phase.

Once the die-cut cardboard sheet (2) has been positioned inside the shaping unit (6), the shaping of the box (10) itself is initiated, by means of the descent of the inner mould composed of its four segments (7*a*, 7*b*, 7*c*, 7*d*), which fall on each one of the lower corners of what will be the formed box (10), as can be observed in FIG. 2. The inner mould, composed of its four segments (7*a*, 7*b*, 7*c*, 7*d*) inlays the die-cut cardboard sheet (2), inside the matrix composed of its four segments (8*a*, 8*b*, 8*c*, 8*d*), so that the lateral walls are raised from the body of the die-cut cardboard sheet (2).

Figure 3:
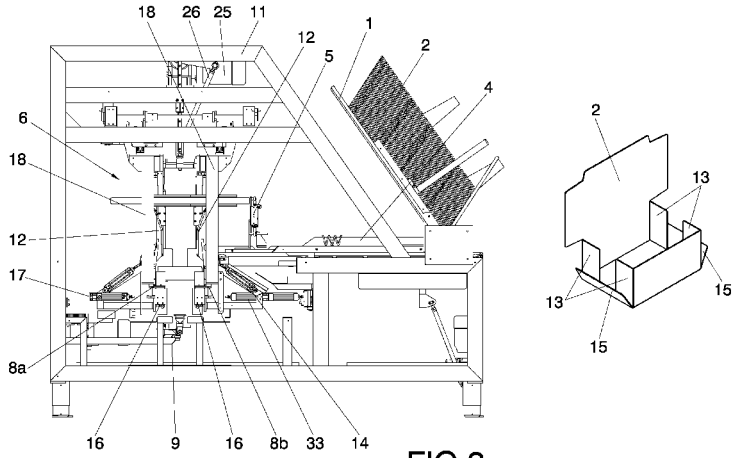
FIG. 3 shows an elevational view of the machine in operation with the inner mould inlaying the die-cut cardboard sheet on the matrix and with the lateral blades actuated to fold the inner flaps. This figure is accompanied by a representation of the die-cut cardboard sheet, illustrating the configuration that is being adopted by the box in this phase.
Figure 4:
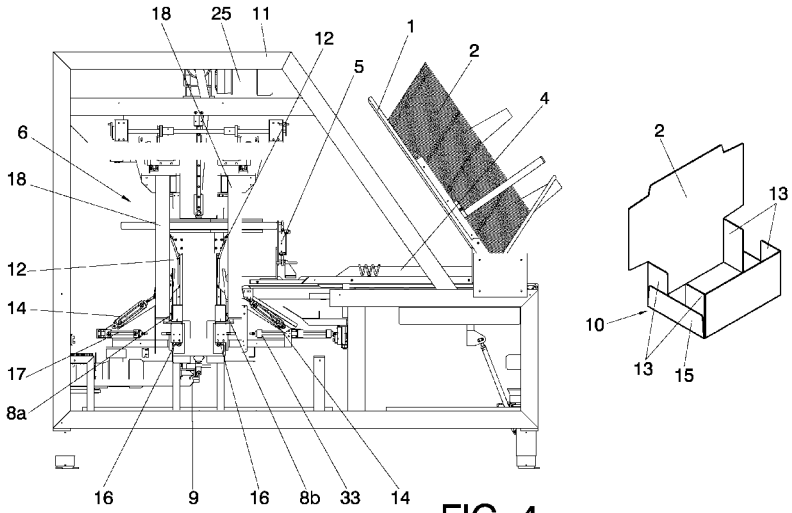
FIG. 4 shows an elevational view of the machine in operation with the inner mould inlaying the die-cut cardboard sheet on the matrix, with the lateral blades actuated to fold the inner flaps and with the lateral folding platforms actuated to fold and press the lateral flaps. This figure is accompanied by a representation of the die-cut cardboard sheet, illustrating the configuration of the finished box in this phase, about to be discharged.
Figure 5:
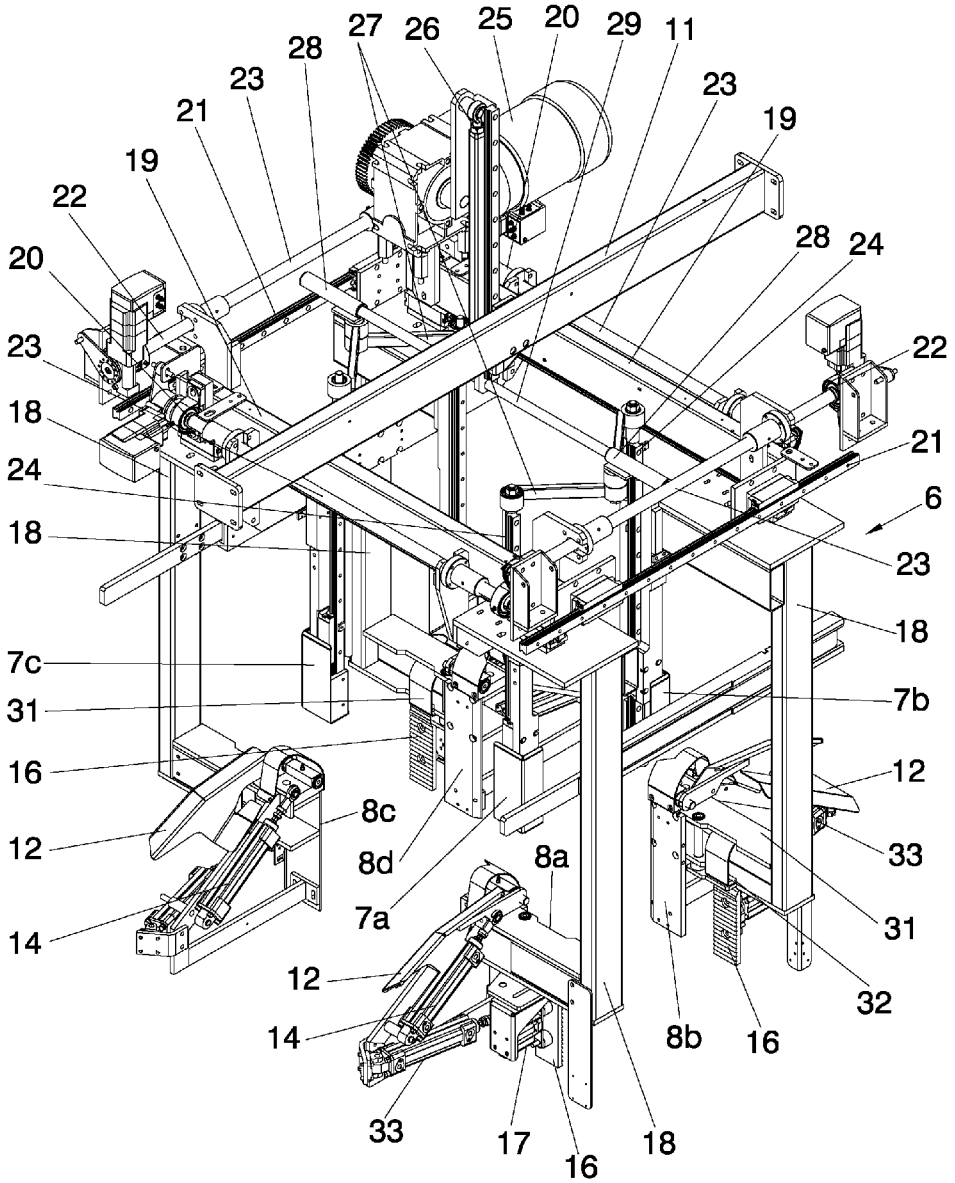
FIG. 5 shows a perspective view of the shaping unit of the forming machine in open position, wherein the segments which constitute the inner mould and the matrix and the motorized screws for the format change can be observed.
Figure 6:
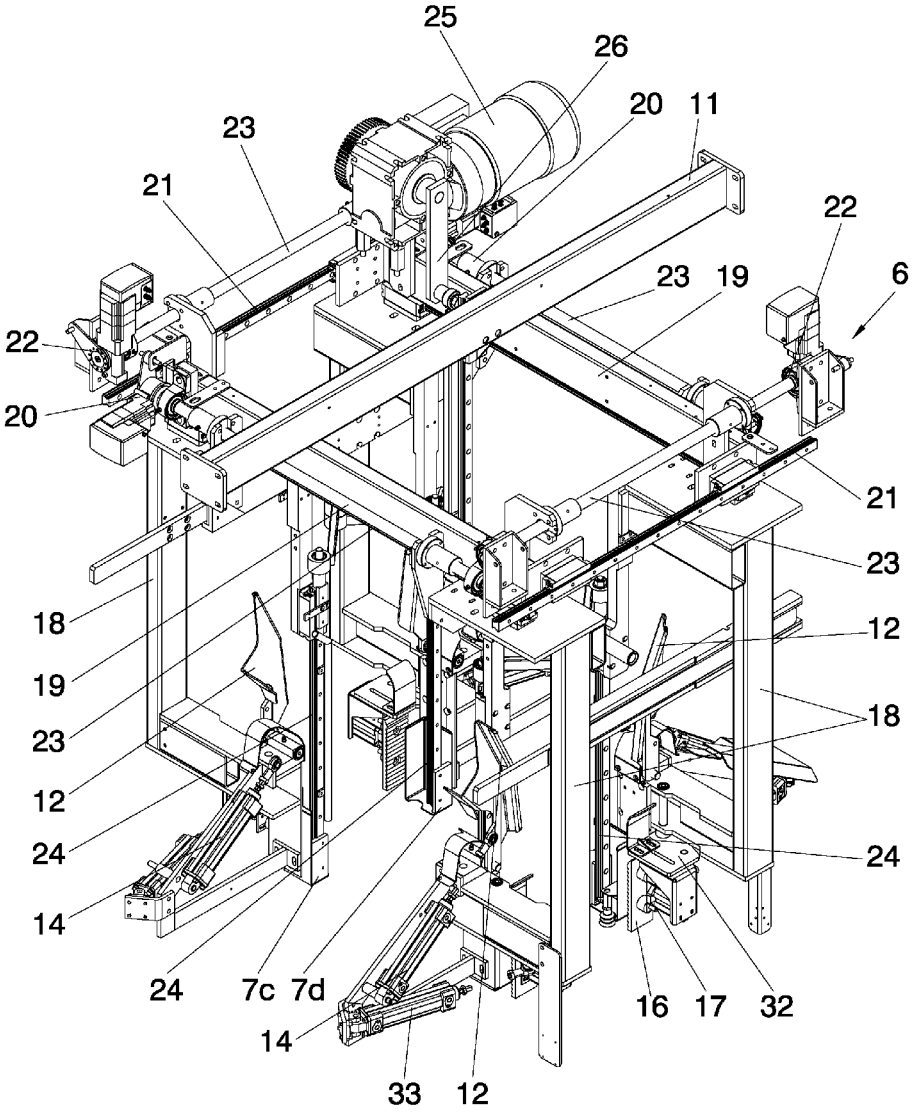
FIG. 6 shows a perspective view of the shaping unit of the forming machine similar to the previous figure, but in closed position, wherein the press inlaid on the matrix, with the blades and lateral press actuated for the shaping of the box, can be observed.
Figure 7:
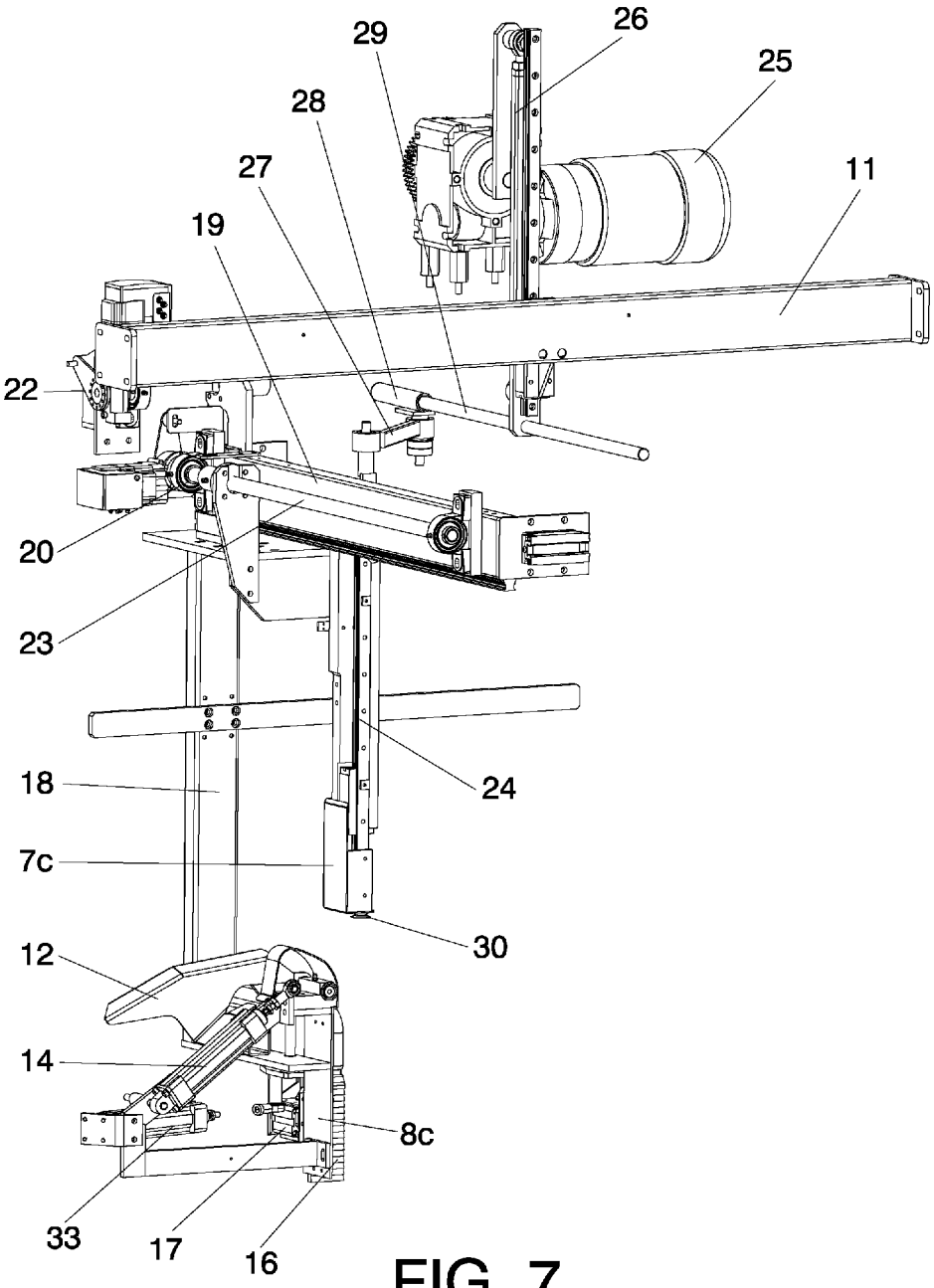
FIG. 7 shows a partial perspective view of the shaping unit, wherein one of the mould-matrix segment units can be observed in open position.
Figure 8:
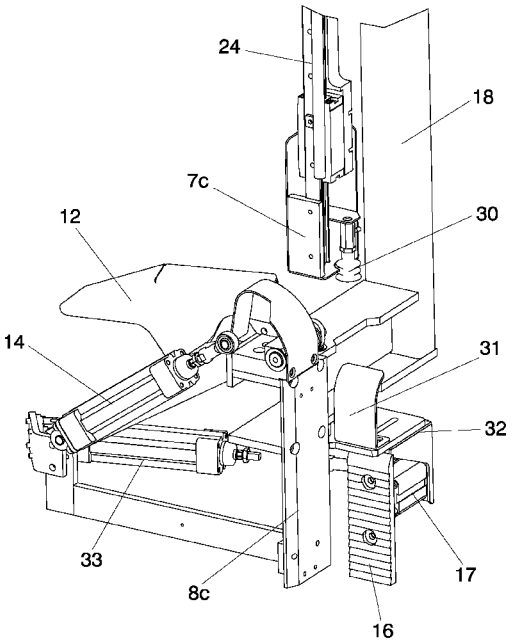
FIG. 8 shows a partial perspective view of a close-up of the mould-matrix segment unit, in open position, wherein the arrangement of the lateral blade, the folding platform with its curved plate and its press, as well as its respective actuation means, can be observed.
Figure 9:
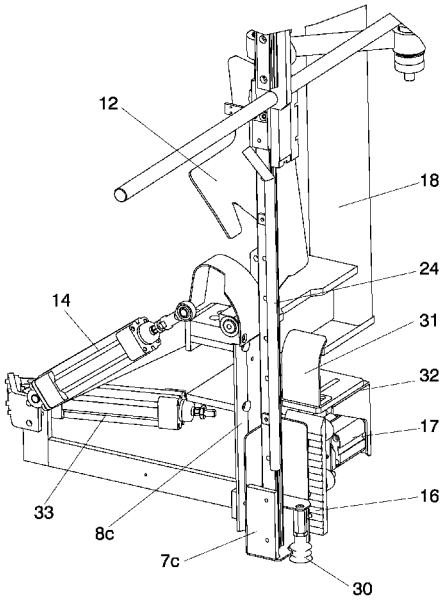
FIG. 9 shows a partial perspective view of a close-up of the mould-matrix segment unit similar to the previous figure, but in closed position, wherein the actuation of the press can be observed.
Figure 10:
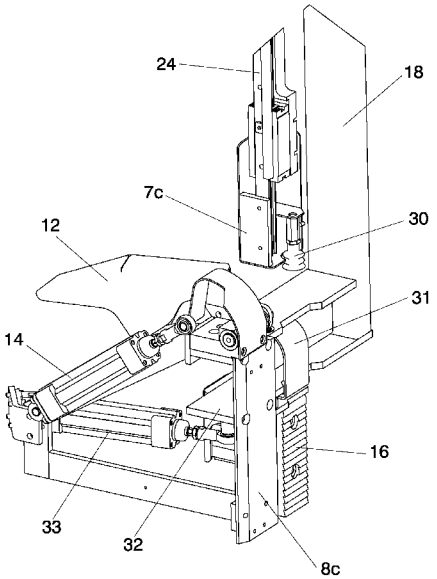
FIG. 10 shows a partial perspective view of a close-up of the mould-matrix segment unit, with the mould segment rising and the platform retracted to allow the discharge of the shaped box.
Figure 11:
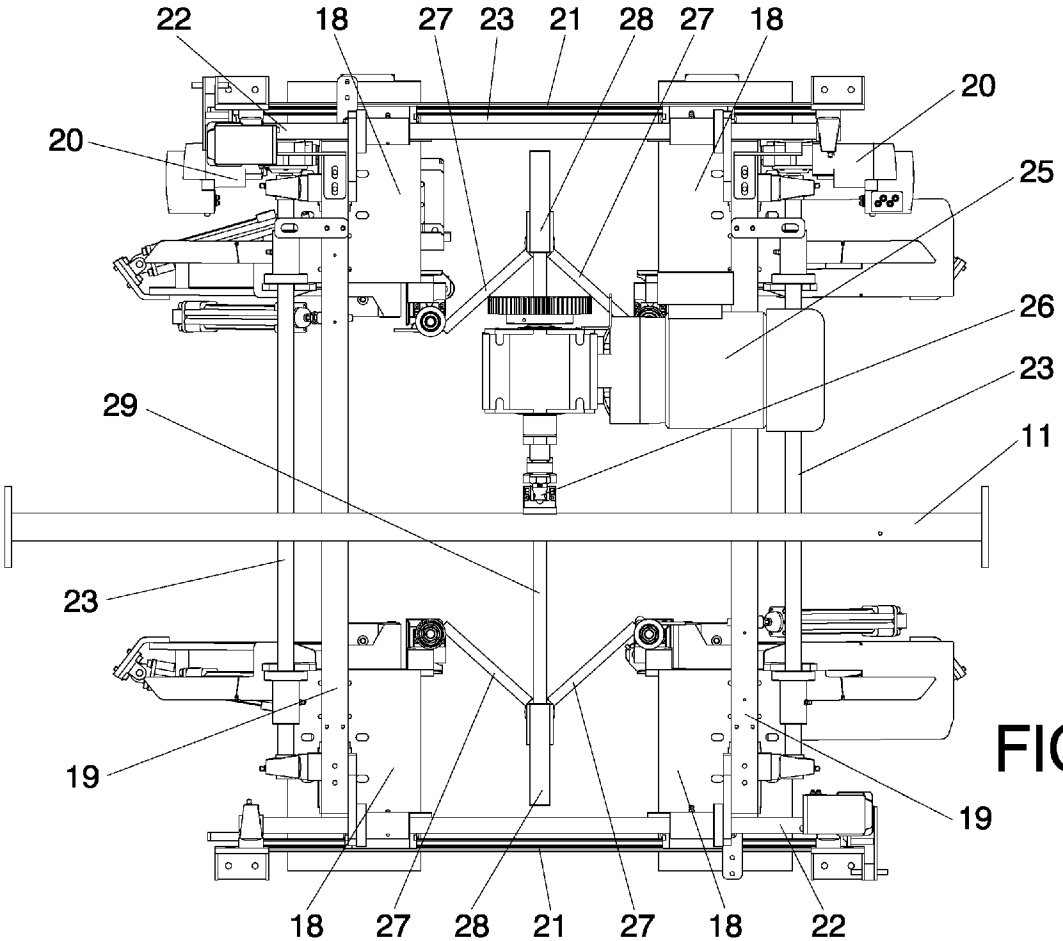
FIG. 11 shows a plan view of the shaping unit wherein the arms which connect the inner mould segments to the actuator can be observed.

As can be observed in FIGS. 2 and 3, when the descent of the inner mould composed of its four segments (7*a*, 7*b*, 7*c*, 7*d*) is initiated, the lateral articulated blades (12) mounted on each one of the matrix segments (8*a*, 8*b*, 8*c*, 8*d*) are actuated for the folding of the inner flaps (13), which will constitute part of the lateral walls of the box (10). In the present example of embodiment, said blades (12) are articulated from their lower end on the side of the corresponding matrix segment (8*a*, 8*b*, 8*c*, 8*d*) and actuated by a pneumatic cylinder (14).

To finalise the shaping of the box (10), the lateral flaps (15) are folded and pressed by actuation of curved plates (31) disposed on the sides of each one of the matrix segments (8*a*, 8*b*, 8*c*, 8*d*). These curved plates (31) are mounted on folding platforms (32), articulated at the sides of each one of the matrix segments (8*a*, 8*b*, 8*c*, 8*d*). These folding platforms (32) further comprise a press (16) actuated by a pneumatic cylinder (17), which strengthens the joining of the inner flaps (13) against the lateral flaps (15), by means of the adhesive substance previously placed on the areas of common contact. Said platforms (32) are folded down through actuation means (33) so that, once the box (10) is formed, the platforms (32) can be retracted, with their respective curved plates (31) and presses (16), and therefore clear the path for the box (10) to be discharged.

Once the box (10) has been shaped, the machine raises the inner mould composed of its four segments (7*a*, 7*b*, 7*c*, 7*d*), as well as the retraction of the folding platforms (32) and the withdrawal of the lateral blades (12), to discharge the formed box (10), through the discharge arm (9).

The box having been discharged from the forming machine, a new cycle would be initiated for the forming of another box (10) of the same characteristics, until reaching the desired number of boxes (10).

When the packaging needs require another format of box (10), the parameters of the new box only need to be entered in the control panel for the format changing mechanism of the shaping unit (6) to position the four inner mould segment units (7*a*, 7*b*, 7*c*, 7*d*) and matrix (8*a*, 8*b*, 8*c*, 8*d*) at the points corresponding to the lower corners of the new box (10). Once the machine has been adjusted, the die-cut cardboard sheets (2) of the storage tray (1) are changed.

As can be observed in FIGS. 5 to 11, the format changing mechanism comprises four C-shaped arms (18), on whose lower ends are mounted the matrix segments (8*a*, 8*b*, 8*c*, 8*d*), with their respective lateral articulated blades (12) and lateral folding presses (16), whose arms (18) are hung at the upper ends thereof from a set of transversal rails (19) assisted by motorized screws (20), for the transversal displacement of the arms (18), and therefore from the matrix segments (8*a*, 8*b*, 8*c*, 8*d*). The transversal rails (19) are mounted on a second set of longitudinal rails (21), solidly joined to the general chassis (11) of the machine, assisted by another pair of motorized screws (22), for the longitudinal displacement of the arms (18), and therefore of the matrix segments (8*a*, 8*b*, 8*c*, 8*d*).

The motorized screws (20, 22) comprise a threaded shaft (23) with two equal spiral portions in each direction, i.e. one threaded to the left and another threaded to the right, so that when the motor makes the screw turn, the respective mould-matrix segment units move in the opposite direction, getting further apart or closer together. Therefore, by actuating the different motorized screws (20, 22), we achieve the positioning of the four mould-matrix segment units on each one of the lower corners of the box (10) for the shaping thereof.

The four inner mould segments (7*a*, 7*b*, 7*c*, 7*d*) are mounted on the upper ends of the C-shaped arms (18), through a guided rod (24), so that they move horizontally, accompanying their respective matrix segments (8*a*, 8*b*, 8*c*, 8*d*) in order to maintain a constant distance between mould and matrix.

As we have previously stated, the inner mould composed of its four segments (7*a*, 7*b*, 7*c*, 7*d*) moves vertically and alternately inside the matrix composed of its four segments (8*a*, 8*b*, 8*c*, 8*d*) to shape the box (10). In the present example of embodiment, the actuation of the four segments (7*a*, 7*b*, 7*c*, 7*d*) which shape the inner mould is performed by means of an electric motor (25) and a rotating slider crank mechanism which transforms the rotational movement into an alternative linear movement. The connection of the end of the crank (26) with the guiding rods (24) of the inner mould segments (7*a*, 7*b*, 7*c*, 7*d*) for the transmission of the vertical and alternate movement is performed through four articulated arms (27), connected at the outer end to the upper ends of the guided rods (24), and at the lower end on two slides (28) which slide along a transversal rail (29), connected to the lower end of the crank (26). The four arms (27) are articulated by means of vertical axes of rotation to allow the horizontal displacement of the mould segments (7*a*, 7*b*, 7*c*, 7*d*). Therefore, when the format changing mechanism displaces the arms (18) to position them to the new format, the arms (27) will articulate and slide to adapt to the new configuration, without losing their connection with the rotating slider crank mechanism (26).

Lastly, it must be pointed out that the lower end of each one of the mould segments (7*a*, 7*b*, 7*c*, 7*d*) comprises a pneumatically assisted suction pad (30) for fastening the box (10).

The invention claimed is:

1. Multiformat box forming machine comprising:

a storage unit (1) for storing die-cut cardboard sheets (2), a loader (3) for unit-by-unit dispensing of the die-cut sheets (2), guiding and positioning means (4) for the die-cut sheet (2), means (5) for supplying an adhesive substance on the die-cut cardboard sheet (2), a shaping unit (6) comprising at least a vertically displaceable inner mould and an exterior matrix, and means (9) for discharging the formed box (10), wherein the mould and the matrix of the shaping unit (6) are divided into four segments (7*a*, 7*b*, 7*c*, 7*d*) and (8*a*, 8*b*, 8*c*, 8*d*), respectively, which allow horizontal displacement and positioning thereof at the points which coincide with the lower corners of the box (10), it having been provided that each one of the units of mould-matrix segments (7*a*, 8*a*), (7*b*, 8*b*) (7*c*, 8*c*)and (7*d*, 8*d*) move solidly joined together so as to maintain the clearances between mould and matrix;

the shaping unit (6) further comprising actuation means (25) for the vertical and alternate displacement of the four segments (7*a*, 7*b*, 7*c*, 7*d*) which shape up the inner mould, wherein the four segments (7*a*, 7*b*, 7*c*, 7*d*) which shape the inner mould are connected to the actuation means (25) through four articulated arms (27) with vertical axes of rotation, connected at the outer end to the upper ends of the guided rod (24) of the mould segments (7*a*, 7*b*, 7*c*, 7*d*), and at the inner end on two slides (28) which slide along a transversal rail (29) connected to the actuation means (25), in order to allow the horizontal displacement of the four mould segments (7*a*, 7*b*, 7*c*, 7*d*) and the positioning thereof on the lower corners of the box (10).

2. Multiformat box forming machine, according to claim 1, wherein each one of the matrix segments (8*a*, 8*b*, 8*c*, 8*d*) comprises a lateral articulated blade (12) which comprises actuation means (14) for folding the inner flaps (13) of the box (10).

3. Multiformat box forming machine, according to claim 2, wherein the actuation means (14) of the lateral articulated blade (12) are pneumatic, hydraulic or electric.

4. Multiformat box forming machine, according to claim 1, wherein each one of the matrix segments (8*a*, 8*b*, 8*c*, 8*d*) comprises a lateral folding platform (32) which comprises a curved plate (31) and a press (16), with their respective actuation means (17, 33), for the folding and pressing of the lateral flaps (15) of the box (10), in order to strengthen their adhesion to the inner flaps (13).

5. Multiformat box forming machine, according to claim 4, wherein the actuation means (17, 33) of the lateral folding platform (32) and the press (16) are pneumatic, hydraulic or electric.

6. Multiformat box forming machine, according to claim 1, wherein the shaping unit (6) comprises a format changing mechanism which comprises four C-shaped arms (18) bearing on their lower ends the matrix segments (8*a*, 8*b*, 8*c*, 8*d*), whose arms (18) are mounted, from their upper ends, on a first set of rails (19) assisted by a pair of motorized screws (20) for the transversal displacement thereof, whose first set of rails (19) is mounted on a second set of rails (21), also assisted by another pair of motorized screws (22), for the longitudinal displacement thereof.

7. Multiformat box forming machine, according to claim 6, wherein the motorized screws (20, 22) comprise a threaded shaft (23) with two equal spiral portions in each direction.

8. Multiformat box forming machine, according to claim 1, wherein each one of the inner mould segments (7*a*, 7*b*, 7*c*, 7*d*) comprises at its lower end a suction pad (30) for fastening the box (10).

9. Multiformat box forming machine, according to claim 1, wherein the actuation means (25) of the four segments (7*a*, 7*b*, 7*c*, 7*d*)which shape the inner mould comprise an electric motor (25) and a rotating slider crank mechanism (26) which transforms the rotational movement into an alternate linear movement.

10. Multiformat box forming machine, according to claim 1, wherein the means for supplying the adhesive substance comprise at least two dispensing glueguns, (5) disposed on the guiding means (4), before the inlet to the shaping unit (6), which deposit a strand of adhesive substance on the lateral flaps (15) of the die-cut cardboard sheet (2).

* * * * *